US005348079A

United States Patent [19]

Tanaka

[11] Patent Number: 5,348,079

[45] Date of Patent: Sep. 20, 1994

[54] HEAT EXCHANGER AND METHOD FOR FIXING A BRACKET THERETO

[75] Inventor: Hiroshi Tanaka, Isesaki, Japan

[73] Assignee: Sanden Corporation, Gunma, Japan

[21] Appl. No.: 133,930

[22] Filed: Oct. 12, 1993

[30] Foreign Application Priority Data

Oct. 15, 1992 [JP] Japan ..... 4-277022

[51] Int. Cl.[5] ..... F28F 9/00

[52] U.S. Cl. ..... 165/67; 165/79

[58] Field of Search ..... 165/67, 79, 149

[56] References Cited

U.S. PATENT DOCUMENTS 3,833,054 9/1974 Gross et al. ..... 165/67

4,441,547 4/1984 Argyle et al. ..... 165/67

FOREIGN PATENT DOCUMENTS 30962 3/1977 Japan ..... 165/149

*Primary Examiner*—John Rivell

*Assistant Examiner*—L. R. Leo

*Attorney, Agent, or Firm*—Baker & Botts

[57] ABSTRACT

A heat exchanger includes a heat exchanger body and at least one bracket attached thereto. The bracket has a resin portion mechanically joined with the heat exchanger body. The bracket can be easily secured to the heat exchanger body by an injected and cured resin forming the resin portion without using mechanical fasteners, such as bolts. Moreover, the bracket and, ultimately, the heat exchanger, can be designed and manufactured to be lightweight.

21 Claims, 3 Drawing Sheets

HEAT EXCHANGER AND METHOD FOR FIXING A BRACKET THERETO

BACKGROUND OF THE INVENTION

1. Field of the Invention

The present invention generally relates to a heat exchanger having a bracket suitable for use in an air conditioning system for vehicles, and a method for fixing the bracket to the heat exchanger.

2. Description of the Related Art

FIG. 8 depicts a conventional heat exchanger for use in an air conditioning system for vehicles including a heat exchanger body 50 which comprises a pair of header pipes 12 and 12' extending parallel to each other. A plurality of parallel heat transfer tubes 10 are disposed between header pipes 12 and 12'. Corrugated fin units 11 extend between adjacent heat transfer tubes 10 and on the outside surfaces of the outermost heat transfer tubes 10. Side plates 14 and 14' are provided on both outermost fin units 11. Caps 15 and 15' close the end openings of header pipes 12 and 12'.

In such a heat exchanger, various types of brackets (not shown) are attached to the heat exchanger body in order to secure the heat exchanger body to a vehicle (not shown). The brackets are fixed to the heat exchanger body by, for example, brazing, or by using fasteners, such as bolts or rivets.

In such a method for fixing a bracket to a heat exchanger body, however, the area on the heat exchanger body capable of receiving the bracket is limited. For example, the bracket cannot be fixed directly to a region in which heat transfer tubes are disposed because the heat transfer tubes would be damaged. Further, in order to secure a bracket to a heat exchanger body by brazing or using fasteners, the bracket itself must be relatively thick to ensure the strength required for the brazing or fastening. Therefore, it is difficult to make the bracket lightweight and, ultimately, to make the entire heat exchanger lightweight.

SUMMARY OF THE INVENTION

It is an object of the present invention to provide a heat exchanger including a bracket in which the bracket can be easily fixed to a heat exchanger body.

It is a further object of the present invention to provide a heat exchanger including a bracket in which the bracket, and thus the heat exchanger, can be made more lightweight.

It is a further object of the present invention to provide a method for easily fixing a bracket to a heat exchanger body.

According to the present invention, a first embodiment of a heat exchanger includes a heat exchanger body and at least one bracket attached to the heat exchanger body. The bracket comprises a bracket body formed from a metal, a resin layer provided at least on a surface of the bracket body facing the heat exchanger body, and a resin portion provided between the heat exchanger body and the resin layer. The resin portion is mechanically joined with the heat exchanger body and chemically with the resin layer.

A second embodiment of a heat exchanger also includes a heat exchanger body and at least one bracket attached to the heat exchanger body. The bracket comprises a bracket body formed from a resin, and a resin portion provided between a heat exchanger body and the bracket body, so that the resin portion is mechanically joined with the heat exchanger body and chemically with the bracket body.

A third embodiment of a heat exchanger also includes a heat exchanger body and at least one bracket attached to the heat exchanger body. The bracket is formed from a resin. The bracket has a resin portion extending through a heat exchanger body, so that the resin portion is mechanically joined with the heat exchanger body.

A fourth embodiment of a heat exchanger also includes a heat exchanger body and at least one bracket attached to the heat exchanger body. The bracket comprises a bracket outer body formed from a metal plate and a bracket inner body formed from a resin. The bracket inner body has a resin portion extending through the width of a heat exchanger body, so that the resin portion mechanically joined with the heat exchanger body.

In these embodiments, according to the present invention, a bracket may be fixed to a heat exchanger body by one of the following preferred methods.

In a heat exchanger according to the first embodiment, a method for fixing a bracket to a heat exchanger body comprises the steps of attaching a bracket body, which is formed from a metal and provided with a resin layer at least on a surface of the bracket body facing the heat exchanger body, to the heat exchanger body; injecting a setting fluid between the heat exchanger body and the bracket body; and curing the setting fluid so that a cured setting fluid is mechanically joined with the heat exchanger body and chemically combined with the resin layer.

In a heat exchanger according to the second embodiment, a method for fixing a bracket to a heat exchanger body comprises the steps of attaching a bracket body formed from a resin to a heat exchanger body; injecting a setting fluid between the heat exchanger body and the bracket body; and curing the setting fluid so that a cured setting fluid is mechanically joined with the heat exchanger body and chemically combined with the bracket body.

In a heat exchanger according to the third embodiment, a method for fixing a bracket to a heat exchanger body comprises the steps of attaching a mold for molding a bracket to a heat exchanger body; injecting a setting fluid into the mold; curing the setting fluid so that a cured setting fluid is mechanically joined with the heat exchanger body; and removing the mold from the heat exchanger body.

In a heat exchanger according to the fourth embodiment, a method for fixing a bracket to a heat exchanger body comprises the steps of attaching a mold, formed from a metal plate for molding a bracket, to a heat exchanger body; injecting a setting fluid into the mold; and curing the setting fluid so that a cured setting fluid is mechanically joined with the heat exchanger body and the mold and the cured setting fluid form the bracket.

In a heat exchanger according to the embodiments described above, a setting fluid includes a polymer or a monomer. Further, "chemical combination" or "chemical bond" includes ionic bond, covalent bond, intermolecular bond, and the like.

In a heat exchanger according to these embodiments, a resin portion of a bracket mechanically joined with a heat exchanger body is formed by injecting a setting fluid, for example, a thermosetting resin, and curing the setting fluid. The resin portion can be mechanically fixed to the heat exchanger body without brazing or using fasteners. Therefore, the attachment and fixing of the bracket may be easier than in a conventional heat exchanger in which brazing or fasteners are used for securing a bracket. In these embodiments there is no damage to the heat exchanger body due to fasteners. Further, because the resin portion can be securely fixed to the heat exchanger body with no fasteners, essentially it is not necessary to provide a metal portion with a large thickness for fastening. Therefore, the bracket and, ultimately, the heat exchanger can be manufactured to be lightweight. Also, because a portion of the heat exchanger body to which the bracket is affixed is shielded by the molded resin portion, the corrosion or deterioration of the affixation portion may be prevented.

Further objects, features, and advantages of the present invention will be understood from the detailed description of the preferred embodiments of the present invention with reference to the appropriate figures.

BRIEF DESCRIPTION OF THE DRAWINGS

Some preferred exemplary embodiments of the invention will now be described with reference to the appropriate figures, which are given by way of example only, and are not intended to limit the present invention.

DETAILED DESCRIPTION OF THE PREFERRED EMBODIMENTS

Figure 1:
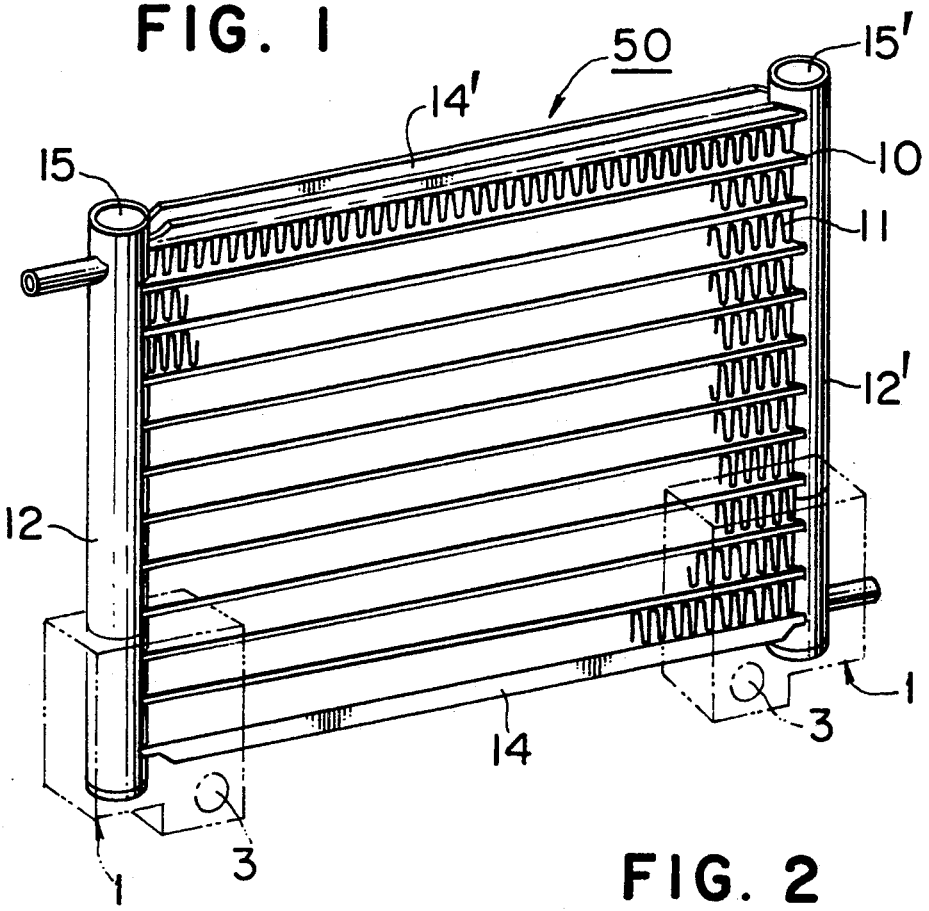
FIG. 1 is a perspective view of a heat exchanger with brackets according to a first embodiment of the present invention.
Figure 2:
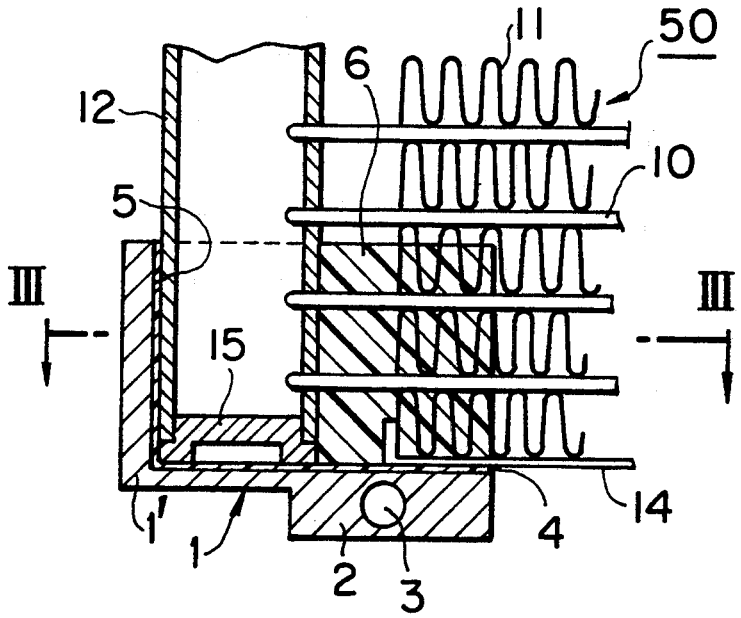
FIG. 2 is an enlarged partial vertical sectional view of the heat exchanger depicted in FIG. 1.
Figure 3:
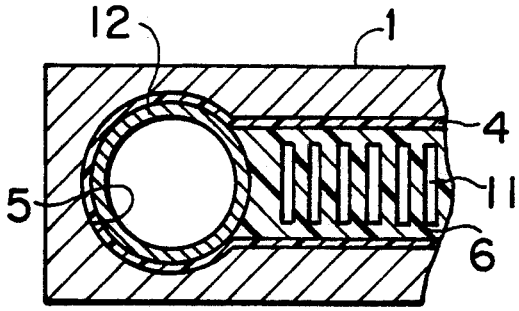
FIG. 3 is a cross-sectional view of the heat exchanger depicted in FIG. 2, taken along line III—III of FIG. 2.

Referring to FIGS. 1–3, a heat exchanger is provided with brackets according to a first embodiment of the present invention. Heat exchanger body 50 is constructed as a multi-flow-type heat exchanger, such as a parallel flow-type condenser, for use in an air conditioning system for vehicles.

Figure 8:
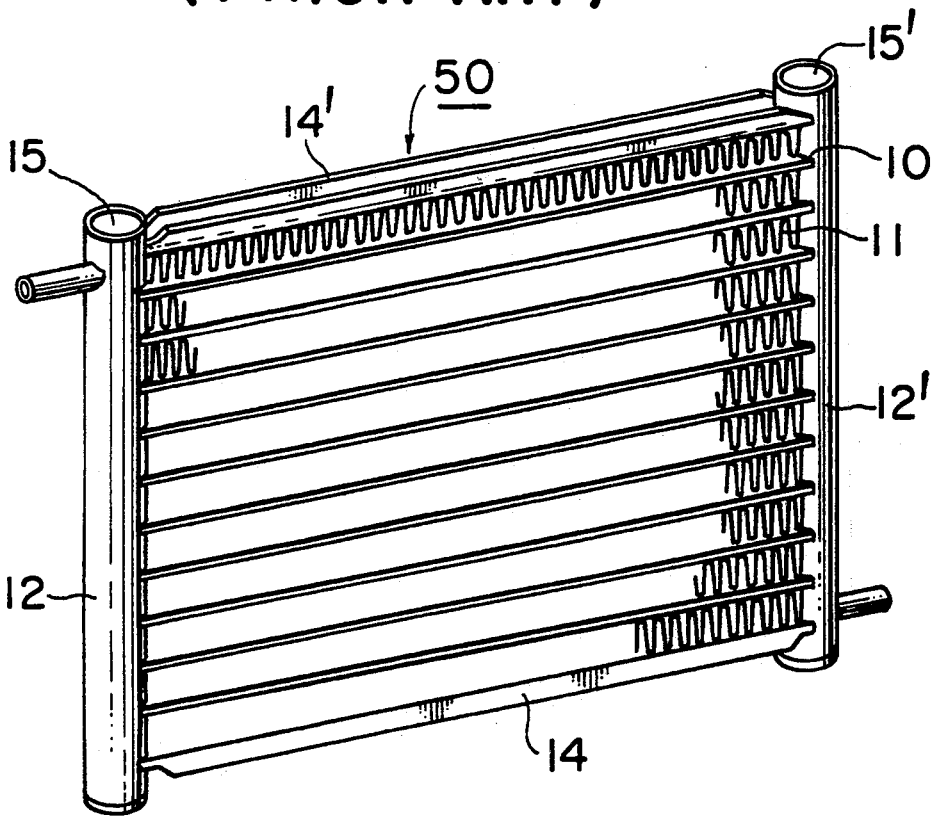
FIG. 8 (PRIOR ART)
FIG. 8 is a perspective view of a conventional heat exchanger in accordance with the prior art.

Heat exchanger body 50 includes header pipes 12 and 12' extending parallel to each other. A plurality of substantially parallel flat heat transfer tubes 10 are disposed between header pipes 12 and 12'. Heat transfer tubes 10 are in fluid communication with header pipes 12 and 12'. A plurality of corrugated fin units 11 are provided, such that each corrugated fin unit 11 is positioned between each two adjacent heat transfer tubes 10. Corrugated fin units 11 are also provided on the outside surface of each outermost heat transfer tube 10. Corrugated fin units 11 may be brazed to heat transfer tubes 10 for permanent assembly. Side plates 14 and 14' are provided on outer sides of both outer corrugated fin units 11. Caps 15 and 15' close end openings of header pipes 12 and 12'. Header pipes 12 and 12', caps 15 and 15', flat heat transfer tubes 10, corrugated fin units 11, and side plates 14 and 14' constitute heat exchanger body 50, basically in the same manner as that of heat exchanger body 50 as depicted in FIG. 8.

At least one bracket 1 is provided for securing the heat exchanger to a vehicle (not shown). In the first embodiment, two brackets 1 are provided, each disposed at a corner of heat exchanger body 50. Bracket 1 comprises bracket body 1', relatively thin resin layer 4, and resin portion 6. Bracket body 1' is formed from a metal. Bracket body 1' has projected portion 2 at the bottom portion thereof. Through hole 3 is defined in projected portion 2 for attachment of bracket 1 to a vehicle (not shown). Enclosing portion 5 is formed in bracket body 1' and encloses a corner portion of heat exchanger body 50 including at least an end portion of header pipe 12 or 12', an end portion of outermost fin unit 11, and an end portion of side plate 14.

Resin layer 4 is provided at least on a surface of bracket body 1' facing the corner portion of heat exchanger body 50. In this embodiment, resin layer 4 is coated on the surface of enclosing portion 5. Resin layer 4 may be composed of, for example, an epoxy resin. Resin portion 6 is formed to fill a space between resin layer 4 and the corner portion of heat exchanger body 50 in enclosing portion 5. Resin portion 6 is mechanically joined with heat exchanger body 50 and chemically combined with resin layer 4. Namely, resin portion 6 is mechanically joined with heat exchanger body 50 by being filled in the space defined between resin layer 4 and the heat exchanger body 50, and chemically combined with resin layer 4 by being cured according to a method described below.

Bracket 1 is manufactured and fixed to heat exchanger body 50 as follows. First, bracket body 1' with resin layer 4 is attached to a corner of heat exchanger body 50. A setting fluid is injected into enclosing portion 5, so that the space between resin layer 4 and the corner portion of heat exchanger body 50 is filled with the setting fluid. The setting fluid may be a polymer or a monomer, and may be, for example, a thermosetting resin. A suitable setting fluid may comprise, for example, a phenolic resin, a urea resin, an unsaturated polyester resin, a diallylphthalate resin, and an epoxy resin.

In this first embodiment, an epoxy resin is used. This epoxy resin is a mixture of bisphenol-A and epichlorohydrine. In such an epoxy resin, after mixing bisphenol-A and epichlorohydrine, a polymer is formed by, for example, heating, and over time, the viscosity of the mixture gradually increases, until the resin is hardened, i.e., cured. The resin exists in a fluid state from immediately after its mixing until immediately before its final hardening and corresponds to the setting fluid according to the present invention. A hardener, for example, an amine, an amine adduct, a polyamide resin, a polysulfide, or an isocyanate, is contained in this setting fluid. These hardeners also function as agents which provide flexibility.

Such an epoxy resin is cured by, for example, a reaction represented by the following chemical equation.

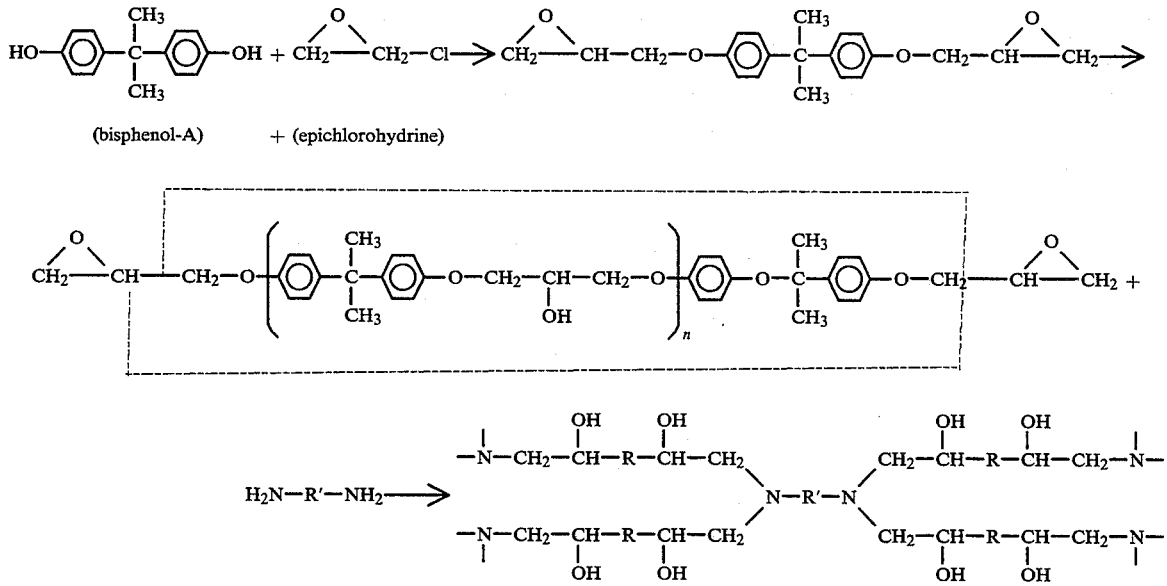

In the above chemical equation, R indicates a portion surrounded by the broken line (an epoxy polymer), and R′ indicates —($CH_2$—)m— group in an amine.

After curing, cured resin portion 6, which is formed by curing of the above-described setting fluid, is strongly joined with heat exchanger body 50. Resin portion 6 is mechanically joined with heat exchanger body 50 and chemically combined with resin layer 4. Bracket body 1′, resin layer 4, and resin portion 6 thus integrally form one bracket 1. Bracket 1 is easily and securely fixed to heat exchanger body 50 without brazing or using fasteners. Because the thickness of bracket body 1′ made from a metal may be small, the total weight of bracket 1 may be manufactured to be lightweight.

Figure 4:
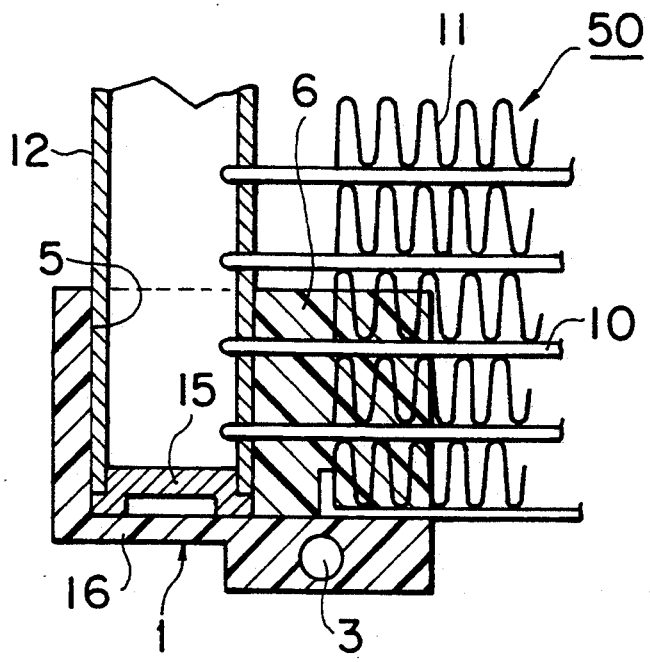
FIG. 4 is a partial vertical sectional view of a heat exchanger with brackets according to a second embodiment of the present invention.

Referring to FIG. 4 in the second embodiment of the present invention bracket 1 comprises bracket body 16 and resin portion 6. Bracket body 16 is made from a resin. Resin portion 6 is formed by injecting a setting fluid into enclosing portion 5 formed in bracket body 16, and curing the setting fluid. Resin portion 6 is mechanically joined with heat exchanger body 50 and chemically combined with bracket body 16. Bracket body 16 may be made from, for example, an epoxy resin or a phenolic resin. Resin portion 6 may be made from either the same resin as, or a different resin from, the resin of bracket body 16. In this embodiment, bracket 1 can be constructed without providing a resin layer.

Figure 5:
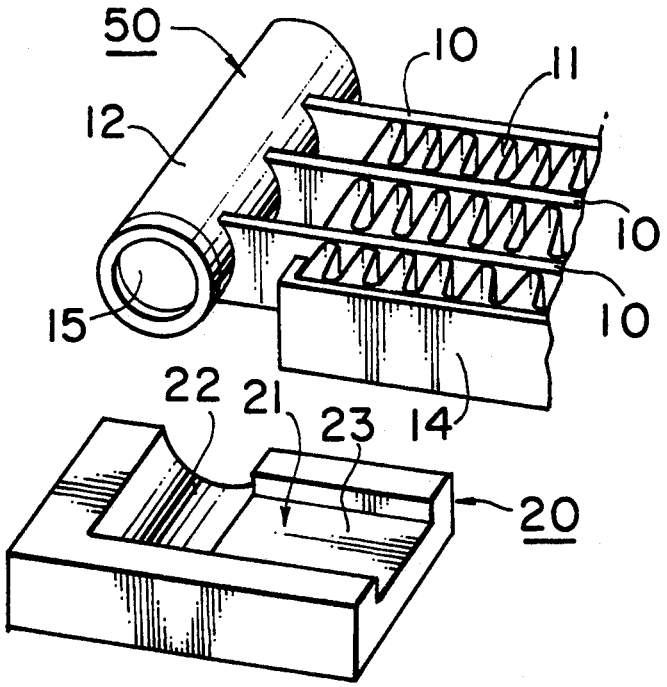
FIG. 5 is an exploded partial perspective view of a heat exchanger and a mold, showing a method for forming a bracket for a heat exchanger with brackets according to a third embodiment of the present invention.
Figure 6:
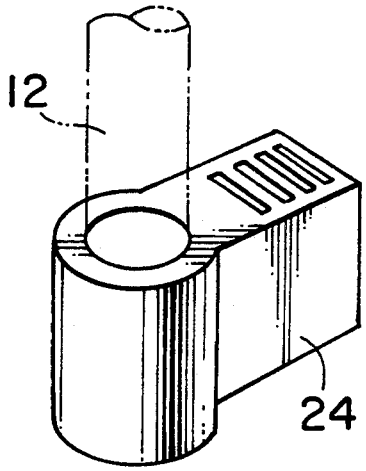
FIG. 6 is a perspective view of a bracket formed by the method shown in FIG. 5.

Referring to FIGS. 5 and 6, in a third embodiment of the present invention, a method for making and fixing a bracket is provided. A pair of molds 20 are attached to a corner of heat exchanger body 50. Referring to FIG. 5, only one piece of molds 20 is illustrated. Molds 20 are formed from a metal. Each mold 20 has a cavity 21 formed from a portion enclosing an end portion of header pipe 12 or 12′ and a portion enclosing at least an end portion of side plate 14 and an end portion of outermost fin unit 11. A setting fluid is injected into each cavity 21 of a pair of molds 20 attached to heat exchanger body 50. Then, the setting fluid is cured by, for example, heating to form bracket 24 as depicted in FIG. 6. After curing, molds 20 are removed from heat exchanger body 50. Bracket 24 is joined mechanically and securely with heat exchanger body 50.

Figure 7:
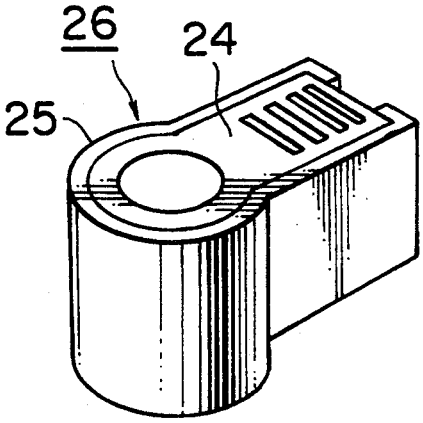
FIG. 7 is a perspective view of a bracket of a heat exchanger with brackets according to a fourth embodiment of the present invention.

Referring to FIG. 7, in a fourth embodiment of the present invention, bracket 26 is provided. Mold 25 is formed from a relatively thin metal plate. Mold 25 is attached to a corner of heat exchanger body 50, and a setting fluid is injected into a cavity of mold 25. The setting fluid is cured by, for example, heating to form a resin portion 24 of bracket 26. Mold 25, however, is not removed after curing. Bracket 26 is formed from resin portion 24 and mold 25. Resin portion 24 is mechanically joined with heat exchanger body 50, thus securely fixing bracket 26 to heat exchanger body 50.

In the above embodiments, a bracket can be easily fixed to a heat exchanger body without using fasteners, such as bolts. Damage to a heat exchanger body due to fasteners, therefore, is prevented. Further, it is not necessary to make a bracket body from a relatively thick plate. Thus, the bracket and, ultimately, the entire heat exchanger, may be manufactured to be lightweight. Moreover, because the bracket is fixed to the heat exchanger body without brazing, the bracket can be fixed to any portion of the heat exchanger body even after assembly of the heat exchanger body. Also, a resin portion of the bracket can shield a contact portion of the heat exchanger body, thus preventing corrosion or deterioration of the contact portion.

Although several preferred embodiments of the present invention have been described in detail herein, the invention is not limited thereto. It will be appreciated by those skilled in the art that various modifications can be made without materially departing from the novel and advantageous teachings of the invention. Accordingly, the embodiments disclosed herein are by way of example. It is to be understood that the scope of the invention is not to be limited thereby, but is to be determined by the claims which follow.

What is claimed is:

1. A heat exchanger comprising:

a heat exchanger body; and at least one bracket, said at least one bracket attached to said heat exchanger body, said at least one bracket comprising a bracket body formed from a metal; a resin layer provided at least on a surface of said bracket body facing said heat exchanger body; and a resin portion provided between said heat exchanger body and said resin layer, so that said resin portion is mechanically joined with said heat exchanger body and chemically combined with said resin layer.

2. The heat exchanger of claim 1, said heat exchanger body including a pair of header pipes extending in parallel relation to each other, a plurality of parallel heat transfer tubes fluidly interconnected between said pair of header pipes, a plurality of fin units extending between adjacent heat transfer tubes of said plurality of parallel heat transfer tubes, and at least one outermost fin unit extending on an outside surface of at least one outermost heat transfer tube.

3. The heat exchanger of claim 2, wherein said at least one bracket is disposed at least at a corner of said heat exchanger body, said bracket body has an enclosing portion enclosing therein at least an end portion of at least one of said pair of header pipes and an end portion of said outermost fin unit, and said resin portion extends at least through said end portion of said outermost fin unit.

4. A heat exchanger comprising:

a heat exchanger body; and at least one bracket, said at least one bracket attached to said heat exchanger body, said at least one bracket comprising a bracket body formed from a resin; and a resin portion provided between said heat exchanger body and said bracket body, so that said resin portion is mechanically joined with said heat exchanger body and chemically combined with said bracket body.

5. The heat exchanger of claim 4, said heat exchanger body including a pair of header pipes extending in parallel relation to each other, a plurality of parallel heat transfer tubes fluidly interconnected between said pair of header pipes, a plurality of fin units extending between adjacent heat transfer tubes of said plurality of parallel heat transfer tubes, and at least one outermost fin unit extending on an outside surface of at least one outermost heat transfer tube.

6. The heat exchanger of claim 5, wherein said at least one bracket is disposed at least at a corner of said heat exchanger body, said bracket body has an enclosing portion enclosing therein at least an end portion of at least one of said pair of header pipes and an end portion of said outermost fin unit, and said resin portion extends at least through said end portion of said outermost fin unit.

7. A heat exchanger comprising:

a heat exchanger body; and at least one bracket, said at least one bracket attached to said heat exchanger body, said at least one bracket being formed from a resin, said at least one bracket having a resin portion extending through the width of said heat exchanger body, so that said resin portion is mechanically joined with said heat exchanger body.

8. The heat exchanger of claim 7, said heat exchanger body including a pair of header pipes extending in parallel relation to each other, a plurality of parallel heat transfer tubes fluidly interconnected between said pair of header pipes, a plurality of fin units extending between adjacent heat transfer tubes of said plurality of parallel heat transfer tubes, and at least one outermost fin unit extending on an outside surface of at least one outermost heat transfer tube.

9. The heat exchanger of claim 8, wherein said at least one bracket is disposed at least at a corner of said heat exchanger body, said at least one bracket has an enclosing portion enclosing therein at least an end portion of at least one of said pair of header pipes and an end portion of said outermost fin unit, and said resin portion extends at least through said end portion of said outermost fin unit.

10. A heat exchanger comprising:

a heat exchanger body; and at least one bracket, said at least one bracket attached to said heat exchanger body, said at least one bracket comprising a bracket outer body formed from a metal plate; and a bracket inner body formed from a resin, said bracket inner body having a resin portion extending through the width of said heat exchanger body, so that said resin portion is mechanically joined with said heat exchanger body.

11. The heat exchanger of claim 10, said heat exchanger body including a pair of header pipes extending in parallel relation to each other, a plurality of parallel heat transfer tubes fluidly interconnected between said pair of header pipes, a plurality of fin units extending between adjacent heat transfer tubes of said plurality of parallel heat transfer tubes, and at least one outermost fin unit extending on an outside surface of at least one outermost heat transfer tube.

12. The heat exchanger of claim 11, wherein said at least one bracket is disposed at least at a corner of said heat exchanger body, said bracket inner body has an enclosing portion enclosing therein at least an end portion of at least one of said pair of header pipes and an end portion of said outermost fin unit, and said resin portion extends at least through said end portion of said outermost fin unit.

13. A method for fixing a bracket to a heat exchanger body comprising the steps of:

attaching a bracket body, which is formed from a metal and provided with a resin layer at least on a surface of said bracket body facing said heat exchanger body, to said heat exchanger body;

injecting a setting fluid between said heat exchanger body and said bracket body; and curing said setting fluid so that a cured setting fluid is mechanically joined with said heat exchanger body and chemically combined with said resin layer.

14. The bracket fixing method of claim 13, wherein said setting fluid is selected from the group consisting of polymers and monomers.

15. A method for fixing a bracket to a heat exchanger body comprising the steps of:

attaching a bracket body, which is formed from a resin, to said heat exchanger body;

injecting a setting fluid between said heat exchanger body and said bracket body; and curing said setting fluid so that a cured setting fluid is mechanically joined with said heat exchanger body and chemically combined with said bracket body.

16. The bracket fixing method of claim 15, wherein said setting fluid is selected from the group consisting of polymers and monomers.

17. A method for fixing a bracket to a heat exchanger body comprising the steps of:

attaching a mold to said heat exchanger body;

injecting a setting fluid into said mold; and curing said setting fluid, so that a cured setting fluid is mechanically joined with said heat exchanger body.

18. The bracket fixing method of claim 17 further comprising the step of removing said mold from said heat exchanger body.

19. The bracket fixing method of claim 18, wherein said setting fluid is selected from the group consisting of polymers and monomers.

20. The bracket fixing method of claim 17, wherein said mold is formed from a metal plate, said mold and said cured setting fluid forming said bracket.

21. The bracket fixing method of claim 20, wherein said setting fluid is selected from the group consisting of polymers and monomers.

* * * * *

UNITED STATES PATENT AND TRADEMARK OFFICE

CERTIFICATE OF CORRECTION

PATENT NO. : 5,348,079

DATED : September 20, 1994

INVENTOR(S) : Hiroshi Tanaka

It is certified that error appears in the above-indentified patent and that said Letters Patent is hereby corrected as shown below:

On the title of the patent, in section [56], "References Cited", under "U.S. PATENT DOCUMENTS" please insert:

| | | |
|---|---|---|
| --3,978,687 | 09/1976 | Calzadilla |
| 4,589,265 | 05/1986 | Nozawa |
| 4,957,158 | 09/1990 | Ando--. |

Signed and Sealed this

Sixth Day of December, 1994

*Attest:*

*Attesting Officer*

Bruce Lehman

BRUCE LEHMAN

*Commissioner of Patents and Trademarks*